US008198823B2

(12) United States Patent
Chen

(10) Patent No.: US 8,198,823 B2
(45) Date of Patent: Jun. 12, 2012

(54) METHOD AND GAS DISCHARGE LAMP WITH FILTER TO CONTROL CHROMATICITY DRIFT DURING DIMMING

(75) Inventor: Nancy H. Chen, North Andover, MA (US)

(73) Assignee: Osram Sylvania Inc., Danvers, MA (US)

( * ) Notice: Subject to any disclaimer, the term of this patent is extended or adjusted under 35 U.S.C. 154(b) by 314 days.

(21) Appl. No.: 12/622,801

(22) Filed: Nov. 20, 2009

(65) Prior Publication Data

US 2011/0121759 A1 May 26, 2011

(51) Int. Cl.
*H05B 37/02* (2006.01)

(52) U.S. Cl. ..... 315/291; 315/297; 315/307

(58) Field of Classification Search ..... 315/291, 315/297, 307–308, 324; 313/110, 112, 116
See application file for complete search history.

(56) References Cited

U.S. PATENT DOCUMENTS

| | | | | |
|---|---|---|---|---|
| 4,216,413 | A * | 8/1980 | Plas | 315/323 |
| 4,709,184 | A | 11/1987 | Keeffe et al. | |
| 4,859,899 | A | 8/1989 | Keeffe et al. | |
| 4,963,790 | A | 10/1990 | White et al. | |
| 5,057,743 | A | 10/1991 | Krasko et al. | |
| 5,327,042 | A | 7/1994 | Bazin et al. | |
| 5,424,618 | A * | 6/1995 | Bertenshaw et al. | 315/324 |
| 5,604,411 | A * | 2/1997 | Venkitasubrahmanian et al. | 315/307 |
| 5,694,002 | A | 12/1997 | Krasko et al. | |
| 6,172,466 | B1 * | 1/2001 | Ki et al. | 315/224 |
| 6,501,220 | B1 | 12/2002 | Lambrechts et al. | |
| 6,639,341 | B1 | 10/2003 | Sakai et al. | |
| 7,012,375 | B2 | 3/2006 | Brock | |
| 7,019,469 | B1 * | 3/2006 | Thurk et al. | 315/307 |
| 7,030,543 | B2 | 4/2006 | Galvez et al. | |
| 7,256,546 | B2 | 8/2007 | Brock et al. | |
| 2011/0085168 | A1 * | 4/2011 | Phillips et al. | 356/400 |
| 2011/0187256 | A1 * | 8/2011 | Tyagi et al. | 313/1 |

FOREIGN PATENT DOCUMENTS

EP 1 335 406 8/2003

OTHER PUBLICATIONS

Ng Joh Joh et al., Understanding Avago Technologies RGB Color Sensors, Avago Technologies Limited (2006).

* cited by examiner

*Primary Examiner* — Tung X Le
(74) *Attorney, Agent, or Firm* — Andrew Martin

(57) ABSTRACT

Techniques are disclosed that allow for the use of metal halide lamps in dimming applications, as well as other discharge lamps susceptible to dimming-induced chromaticity drift. Examination of such lamps reveals that some of the spectral changes that cause chromaticity drift during dimming are localized in narrow band regions of the spectrum, and lamp emission in these regions is enhanced (either increased or decreased) relative to the rest of the spectrum. Selective filtering of the enhanced emission caused by dimming can be used to reduce chromaticity shift. For instance, a filter deposited on and/or integrated into a lamp component (such as the arc tube, shroud, and/or outer jacket) operates to block transmission of those regions of the spectrum.

19 Claims, 12 Drawing Sheets

METHOD AND GAS DISCHARGE LAMP WITH FILTER TO CONTROL CHROMATICITY DRIFT DURING DIMMING

TECHNICAL FIELD

The present application relates to gas-discharge lamps, and more particularly to filtering discharge lamp emission to control chromaticity drift in dimming applications.

BACKGROUND

Metal halide gas-discharge lamps are commonly used in a number of venues such as sporting arenas and stadiums, plant nurseries, and industrial plants. Like other gas-discharge lamps, metal halide lamps produce light by passing an electric arc through a mixture of gases contained in an arc tube (e.g., argon, mercury, and metal halides). The argon is readily ionized, and enables striking the arc across the lamp electrodes when voltage is applied to the lamp. The heat generated by the arc in turn vaporizes the mercury and metal halides, which produces light as the temperature and pressure increases. The halides generally control the color and intensity of the light produced.

One barrier to the more widespread use of metal halide lamps, and particularly in dimming applications, is an undesirable change in color coordinates, or chromaticity, as the operating power is reduced. Generally, a constant chromaticity is desired for most lighting applications, although certain drift directions may be tolerable. For example, a lamp which dims towards a warmer appearance may be acceptable, such as towards pink-red or towards a lower correlated color temperature (CCT). However, other applications can be intolerant of chromaticity drift.

The current solution to this problem is to simply not use metal halide lamps in dimming applications that are intolerant of chromaticity drift. This of course limits the available opportunities to exploit the various benefits associated with metal halide lamps (e.g., high intensity with good efficiency, etc).

BRIEF DESCRIPTION OF THE DRAWINGS

Reference should be made to the following detailed description which should be read in conjunction with the following figures, wherein like numerals represent like parts.

DETAILED DESCRIPTION

Techniques are disclosed that allow for the use of metal halide lamps in dimming applications, and even those applications that are intolerant of chromaticity drift.

General Overview

Examination of the spectral output of particular experimental metal halide lamps reveals that some of the spectral changes which cause chromaticity drift during dimming were unexpectedly localized in one or a few narrow band regions of the spectrum. In further unexpected fashion, the emission in these narrow regions was enhanced relative to the rest of the spectrum. As now understood, the enhanced emission is due to a reduction in the self-reversal of strong atomic emission lines which leads to an increased emission intensity at line center relative to the rest of the spectrum.

Figure 1:
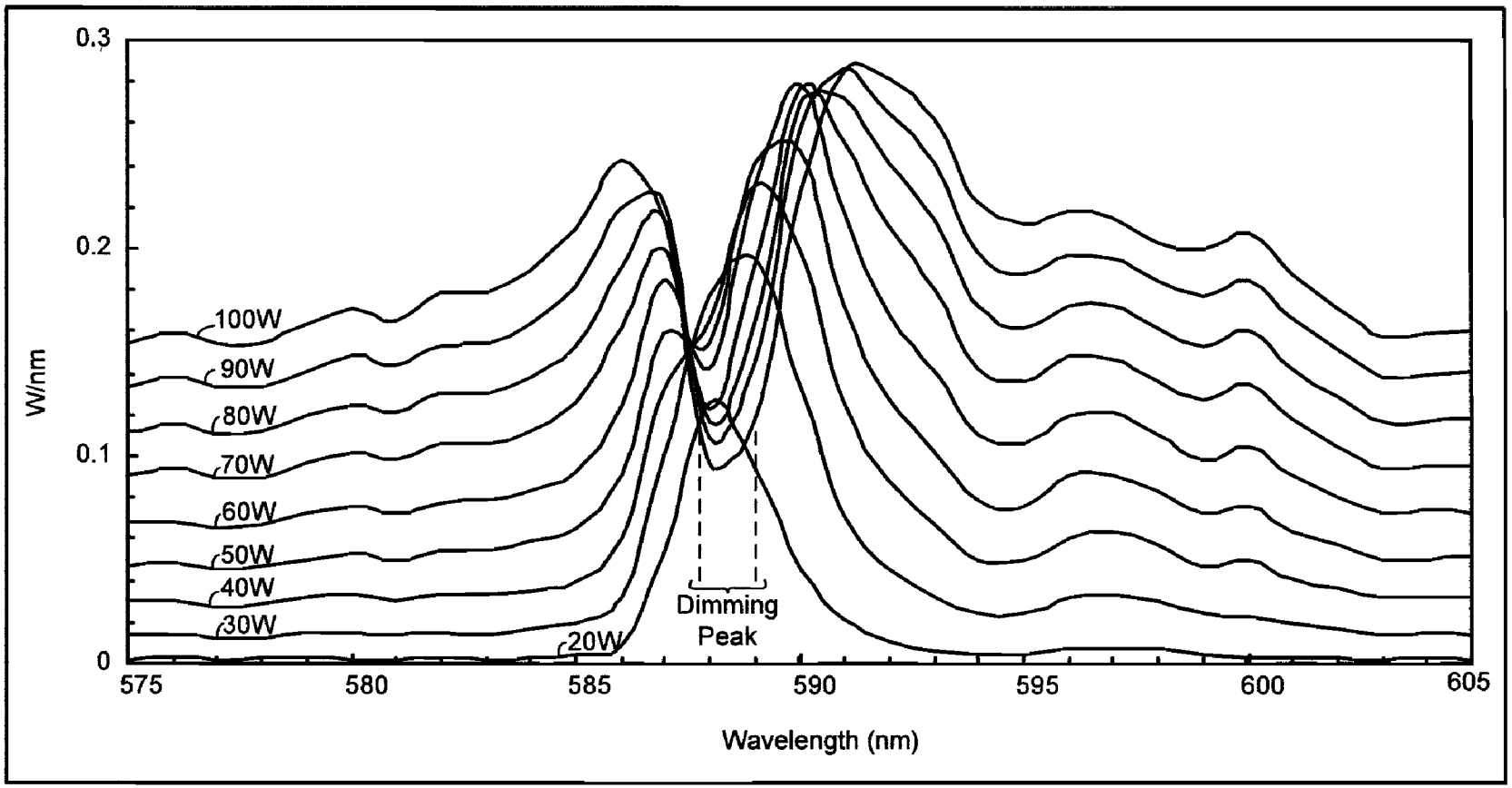
FIG. 1 demonstrates how spectral changes that cause chromaticity drift during dimming operations are localized in narrow band regions of the spectrum.

As an example, FIG. 1 shows the spectral changes that occur near the sodium (Na) resonance line (around 589 nm), for a gas-discharge lamp containing Na that is dimmed from about 100 W to 20 W. As can be seen, the lamp containing Na experiences a chromaticity drift component towards the yellow due to enhancement of the Na resonance line center at 589 nm. Similar behavior is exhibited for strong dysprosium (Dy), holmium (Ho), thulium (Tm), and thallium (Tl) lines in respectively configured lamps. In particular, lamps containing Dy, Ho, or Tm, generally experience a chromaticity drift component towards the blue due to enhancement of the strong lines in that part of the spectrum, and lamps containing Tl generally experience a chromaticity drift component towards the green due to enhancement of emission at the line center of the 535 nm line. The spectral location of such an enhanced emission at lower wattages is generally designated as a dimming peak, as shown in FIG. 1. Further note that the lamp emission (in W/nm) in this location is surprisingly higher at the lowest lamp wattage of 20 W relative to the highest lamp wattage of 100 W. It can also be the case where a dimming peak represents a spectral location at which the lamp emission is surprisingly lower at a lower wattage setting.

In either case filtering the portion of the spectrum containing the dimming peak controls the chromaticity drift caused by the disproportionate changing of the dimming peak when transitioning between higher and lower wattage conditions. The filter operates to block transmission of those regions of the spectrum where the enhanced emission occurs. As such, the human eye can no longer detect the relative enhancement of those wavelengths and the consequent chromaticity drift components that result. Since the spectral changes are generally localized in a few (or less) narrow band regions, the effect of filtering on the overall photometric output is tolerable.

Lamp Structure with Dimming Filters

Figure 2:
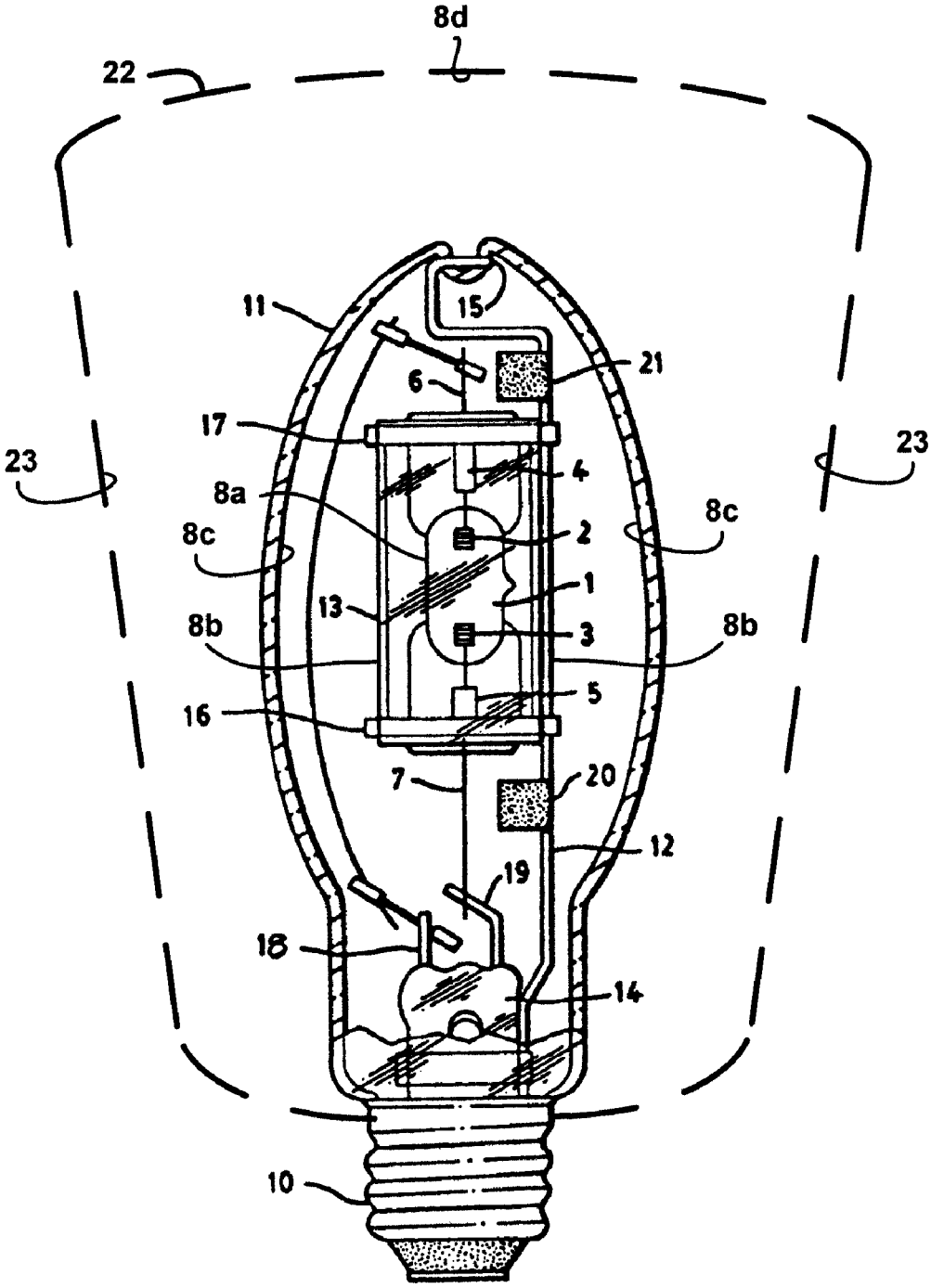
FIG. 2 illustrates a metal halide lamp configured with one or more dimming filters, in accordance with an embodiment of the present invention.

FIG. 2 illustrates an example of a metal halide lamp configured with one or more spectrally selective dimming filters (8*a*, 8*b*, 8*c*, and/or 8*d*) in accordance with an embodiment of the present invention. This example lamp structure is intended to represent a broad range of lamps, and the present invention is not intended to be limited to any particular lamp configuration. Rather, the filtering techniques can be used with most lamp configurations where it is desirable to minimize or otherwise reduce chromaticity drift associated with certain lamp chemistries (such as metal halide lamps) as a result of dimming. Numerous alternative configurations and various combinations of conventional lamp features and materials will be apparent in light of this disclosure.

The example lamp shown includes a discharge tube or arc tube 1 disposed within an outer sealed glass envelope or jacket 11. The outer jacket 11 is evacuated and hermetically sealed to an affixed glass stem member 14 having an external base member 10. A pair of electrical conductors 18 and 19 is sealed into and passes through the stem member 14. The discharge tube 1 has a pair of electrodes 2 and 3 which project into the interior of the discharge tube 1 at respective ends and provide for energization of the discharge lamp by an external power source during operation.

Discharge tube 1 may generally be made, for instance, of quartz, although other types of suitable materials may be used such as polycrystalline alumina. In the example embodiment shown, the discharge tube 1 can be further configured with filtering qualities (generally designated as 8*a* in FIG. 2), so as to specifically remove a spectral location associated with a dimming peak. For instance, the discharge tube 1 can be configured with typical discharge tube qualities, along with absorptive filtering qualities. As is known, an absorptive filter is constructed of optical material such as glass to which various inorganic or organic compounds (e.g., dyes) have been added, and is typically used to create special effects in photography and film applications. In the present application, the discharge tube 1 can be implemented in a similar fashion, but tailored to remove a spectral location associated with an identified dimming peak. For example, it may be possible to add one or more absorbing ionic species to the material of the discharge tube, or to coat the tube with an absorptive coating which filters out the spectral region of the dimming peak. Alternatively, or in addition to, a dichroic or so-called interference filter can be used, where one or more layers of thin film or coatings are deposited onto or otherwise integrated into the discharge tube 1 (e.g., using vacuum deposition). Depending on the location of the spectrum to be filtered relative to the desired spectrum, such an interference filter can be configured as a short-pass filter (i.e., where wavelengths shorter than the filter edge are passed), a long-pass filter (i.e., where wavelengths longer than the filter edge are passed), a bandpass filter (i.e., where wavelengths between the lower and upper filter edges are passed), or a notch filter (i.e., where wavelengths shorter than the lower filter edge and higher than the upper filter edge are passed). As will be apparent in light of this disclosure, the filter edges can be selected so that a spectral location associated with an identified dimming peak is blocked or otherwise attenuated. Note that filter 8*a* is optional, and may be used individually to provide all filtering as described herein, or in combination with other filters (e.g., 8*b*, 8*c*, and/or 8*d*).

Each electrode 2 and 3 includes a core portion surrounded by, for example, molybdenum or tungsten wire coils. Each of the electrodes 2 and 3 in this example lamp configuration is connected to respective metal foils 4 and 5, which are pinch sealed and can be formed of, for example, molybdenum. Electrical conductors 6 and 7, which are electrically connected to respective foils 4 and 5, extend outwardly of the respective press seals. Conductors 6 and 7 are respectively connected to the conductors 18 and 19 projecting from the glass stem member 14. As can be further seen, the connection between conductor 6 and conductor 18 in this example lamp configuration is made by a vertically disposed wire extending exterior to the protective transparent shroud 13. A pair of optional getters 20 and 21 are mounted to the support structure 12 to maintain the vacuum in the outer envelope of a lamp.

The discharge tube 1 is positioned inside the shroud 13 and is electrically isolated from the shroud 13 and the support structure 12. Such a "floating frame" structure can be used to control the loss of alkali metal from the arc tube 1 and is further described in U.S. Pat. Nos. 5,057,743 and in 4,963,790, each of which is incorporated herein by reference in its entirety. The support structure 12 is further held at its upper end by indentation 15 in outer jacket 11.

In the example embodiment shown, for instance, the shroud 13 can be further configured with filtering qualities (generally designated as 8*b* in FIG. 2), so as to remove a spectral location associated with a dimming peak. For instance, the shroud 13 can be configured with typical shroud qualities, along with absorptive filtering qualities in a similar fashion as previously described with reference to the discharge tube 1, wherein the shroud 13 is manufactured with materials that operate to remove a spectral location associated with an identified dimming peak. Alternatively, or in addition to, an interference filter can be used, where one or more layers of thin film or coatings are deposited onto or otherwise integrated into the shroud 13 (e.g., using vacuum deposition). The previous discussion with respect to short-pass, long-pass, bandpass, and notch filters is equally applicable here.

The shroud 13 is secured to the support structure 12 by spaced apart straps 16 and 17 which can be respectively welded or otherwise coupled to a vertically aligned portion of the support member 12. The shroud 13 of this example lamp configuration has a cylindrical shape and may be in the form of, for instance, a quartz sleeve which may or may not have a domed shaped closure at one end. Each of the straps 16 and 17 can be made of a spring like material so as to grippingly hold the shroud 13 in position. As described in U.S. Pat. No. 4,859,899, which is incorporated herein by reference in its entirety, the diameter and length of shroud 13 may be chosen with respect to the arc tube 1 dimensions to achieve an optimal thermal redistribution resulting in uniform arc tube 1 wall temperatures.

The outer jacket 11 can also be further configured with filtering qualities (generally designated as 8*c* in FIG. 2), so as to remove a spectral location associated with a dimming peak. For instance, the outer jacket 11 can be configured with typical outer jacket qualities, along with absorptive filtering qualities as previously described with reference to the discharge tube 1 and shroud 13, wherein the outer jacket 11 is tailored to remove a spectral location associated with an identified dimming peak. Alternatively, or in addition to, an interference filter can be used, where one or more layers of thin film or coatings are deposited onto or otherwise integrated into the outer jacket 11 (e.g., using vacuum deposition). The previous discussion with respect to short-pass, long-pass, bandpass, and notch filters is equally applicable here.

Base 10 may be implemented, for example, with an Edison- or mogul-type base, e.g., such as an E27 or E39 screw base. Note, however, that the lamp may have a medium base or double-ended configuration, or any number of suitable bases or interfaces that allow for electrical connection to a power source. The lamp may also include other structural features commonly found in metal halide gas-discharge lamps, or other such lamps. For instance, the lamp may include an auxiliary starting probe or electrode (e.g., generally made of tantalum or tungsten) which may be provided at the base end of the arc tube adjacent the main electrode 3.

In one example case, the discharge tube 1 contains a chemical fill of inert starting gas, mercury, alkali metal iodides, and scandium iodide. In dispensing the chemical fill into the arc tube of a lamp of the present invention, the non-gaseous components can beneficially be dispensed into the unsealed arc tube prior to introduction of the starting gas. As is now known, a charge of mercury is present in a sufficient amount so as to enhance the electrical characteristics of the lamp by desirably reducing the amperage requirements needed to sustain a desirable discharge in the arc tube. In addition to mercury, an inert ionizable starting gas such as argon is contained within the discharge tube. Note, however, that other noble gases can be substituted for argon provided an appropriate pressure is maintained that is conducive to starting the lamp and minimizing electrode sputtering or evaporation. Gas fill pressures may range from a few torr to several atmospheres.

Further details on one type of lamp that can be utilized in conjunction with the optional getters 20 and 21 is described in U.S. Pat. No. 4,709,184, which is incorporated herein by reference in its entirety. The lamp described there utilizes scandium iodide and the alkali metal iodides are present as the chemical fill and in the discharge gas during lamp operation. In one particular such configuration, the ingredients of scandium iodide and the alkali metal iodides are present in a ratio which provides a warm color of lamp light output comparable to the output of an incandescent lamp. As will be appreciated in light of this disclosure, embodiments of the present invention may be utilized in lamps containing a variety of chemical fills.

The wall temperature of discharge tube 1 is dependent on multiple factors such as light transmissive properties, diameter, length, and wall thickness of the arc tube 1. Providing an evacuated outer jacket 11 tends to increase the cold spot temperature. In accordance with one particular embodiment, the cold spot temperature of the arc tube 1 is from about 800° C. to about 1000° C.

The tendency of the lamp to discolor can be reduced by the inclusion of the getters 20 and 21 in the evacuated envelope 11. The getters 20 and 21 can be secured to a ferrous metal backing which in the example lamp configuration shown can be secured to the support structure 12 by welding or other suitable attachment technique. The outer envelope 11 of the assembled lamp can be subjected to vacuum through a tubulation that is located in the stem 14 of the lamp. Prior to evacuation, the outer envelope 11 may be purged with an inert gas to remove reactive gases such as oxygen. The purge and evacuation can be performed, for instance, at oven baking temperatures so that moisture present in the envelope is also evacuated. Additional details regarding suitable getter materials are provided in U.S. Pat. No. 5,327,042, which is incorporated herein by reference in its entirety. Note, however, that other embodiments may not include getters 20 and 21.

Also shown in FIG. 2 is a housing (generally shown in dashed lines) in which the thus far described light source included within the outer jacket 11 may be enclosed, thereby providing a reflector lamp configuration. As can be seen, the housing generally includes reflective inner walls 23 and a lens 22 for outputting light from the light source. The lens 22 may range from a simple, flat transparent cover to a complex optical element for focusing or diffusing the light. (Other than allowing the light emitted from the lamp to leave the housing, no specific optical properties are intended by the use of the term lens.) The lens 22 can be attached to the forward edge of the reflector walls 23 to enclose the light source included within the outer jacket 11. The lens 22 may be fused, glued, or similarly coupled to the reflector walls 23 as typically done. The reflector walls 23 have an internal reflective surface to reflect the light emitted from light source included within the outer jacket 11. Additional example details of such reflector lamp configurations are provided in U.S. Pat. No. 7,030,543, which is incorporated herein by reference in its entirety.

Further note that such reflector lamp configurations can also be modified to include selective spectral filtering, as will be apparent in light of this disclosure. In the example embodiment shown, for instance, the lens 22 can be further configured with filtering qualities (generally designated as **8*d* in FIG. 2), so as to remove a spectral location associated with a dimming peak. For instance, the lens 22 can be configured with typical shroud qualities, along with absorptive filtering qualities as previously described with reference to the discharge tube 1, shroud 13, and outer jacket 11, wherein the lens 22 can be manufactured or otherwise tailored to remove a spectral location associated with an identified dimming peak. Alternatively, or in addition to, an interference filter can be used, where one or more layers of thin film or coatings are deposited onto or otherwise integrated into the lens 22** (e.g., using vacuum deposition). Again, the previous discussion with respect to filter types (long-pass filters, etc.) and implementation (coatings, integrated, etc.) is equally applicable here.

As will be appreciated in light of this disclosure, one or more dimming filters, such as any one or combination of filters **8*a*, 8*b*, 8*c*, and 8*d*** can be used to eliminate or otherwise reduce dimming-induced chromaticity drift of the lamp. The filtering may be accomplished, for example, by a lamp component having integrated filter qualities, or by conventional thin films or coatings applied to a lamp component and capable of spectral filtering in the target spectral range. Conventional filtering techniques can be used here, for instance, such as those techniques used in implementing filters produced by CVI Melles Griot, including interference soft coated filters (e.g., Melles Griot 03 LWP 604) and color glass filters (e.g., Melles Griot 03 FCG 063). The passband of the filter will depend on the spectral location of the lamp output to be filtered, and can be set accordingly using conventional filter fabrication processes. Combinational filtering schemes can be used as well. For instance, both a long-pass filter and a notch filter can be used, to remove shorter wavelengths as well as a range of longer wavelengths, thereby reducing the chromaticity drift overall.

Numerous other lamp structures that can benefit from filtering as described herein will be apparent in light of this disclosure. For instance, example ceramic metal halide lamps are described in U.S. Pat. No. 7,256,546, and example quartz metal halide lamps are described in U.S. Pat. No. 5,694,002. Each of these patents is incorporated herein by reference in its entirety.

Example Lamp Chemistry

To further demonstrate, various experimental 39 watt ceramic metal halide lamps were constructed, each including mercury (Hg) and multibar xenon (Xe). As can be seen in the lamp composition Table 1, there are effectively three groups of example lamps, each group including lamps with target Hg doses of 1.5, 2.0, and 2.5 mg, with target Xe cold fill pressures of 4, 6, and 8 bar for each respective group, for a total of nine sample lamps. As can be further seen with respect to Table 1, each sample lamp contained 3 mg of a metal halide salt mixture, which in this particular example was composed of $NaI:InI:CaI_2:MgI_2:TmI_3$ in a 10.7:12.5:15.7:16.7:44.4 wt % ratio. The arc tubes were dosed and sealed, and jacketed (single ended tubular, G12 base).

TABLE 1

| Example Lamp Compositions | | | |
|---|---|---|---|
| Lamp ID | Xe (bar) | Hg (mg) | MH salt (mg) |
| 1 | 4 | 1.5 | 3 |
| 2 | 4 | 2.0 | 3 |
| 3 | 4 | 2.5 | 3 |
| 4 | 6 | 1.5 | 3 |
| 5 | 6 | 2.0 | 3 |
| 6 | 6 | 2.5 | 3 |
| 7 | 8 | 1.5 | 3 |
| 8 | 8 | 2.0 | 3 |
| 9 | 8 | 2.5 | 3 |

Figure 3:
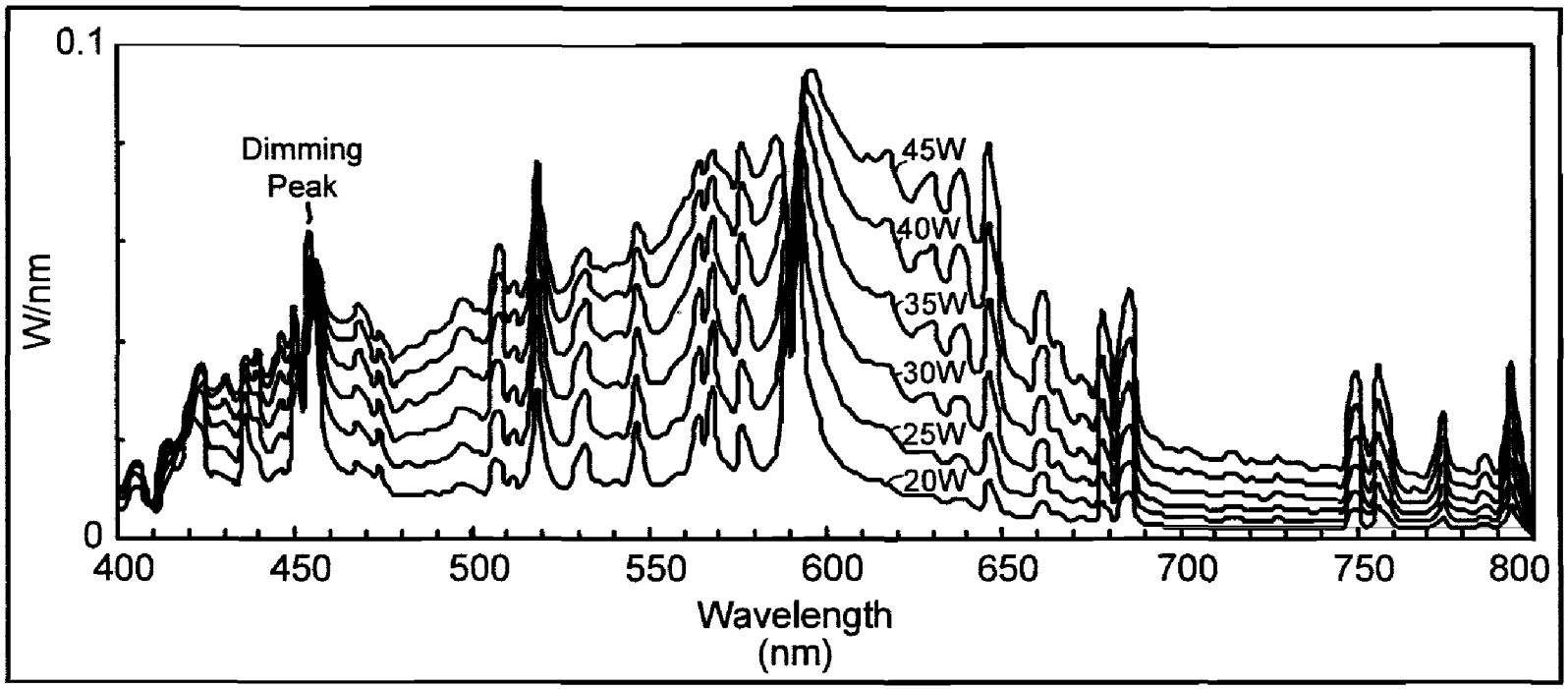
FIG. 3 illustrates the unfiltered spectral output of a metal halide lamp.

Photometric data for these lamps was examined for chromaticity shift as the power was dimmed from 45 W to 20 W. The photometric data included lumens per watt (LPW), color rendering index (CRI), and color correlated temperature (CCT). With dimming, the chromaticity shifts somewhat along the blackbody locus, towards the blue and higher color temperatures. In the examples reflected in Table 1, the shift in chromaticity is due in part to a relative increase in the 451 nm line of atomic indium (In) relative to the rest of the spectrum. There is also a relative increase in emission around 590 nm (Na, yellow) which partially counteracts the drift towards the blue, but not completely. The spectral output of lamp ID 5 (of Table 1) at various powers of operation (from 45 W to 20 W) is shown in FIG. 3. In accordance with an embodiment of the present invention, the effect of the variation in indium (In) line intensity at around 451 nm can be removed by filtering out that part of the spectrum.

Figure 4A:
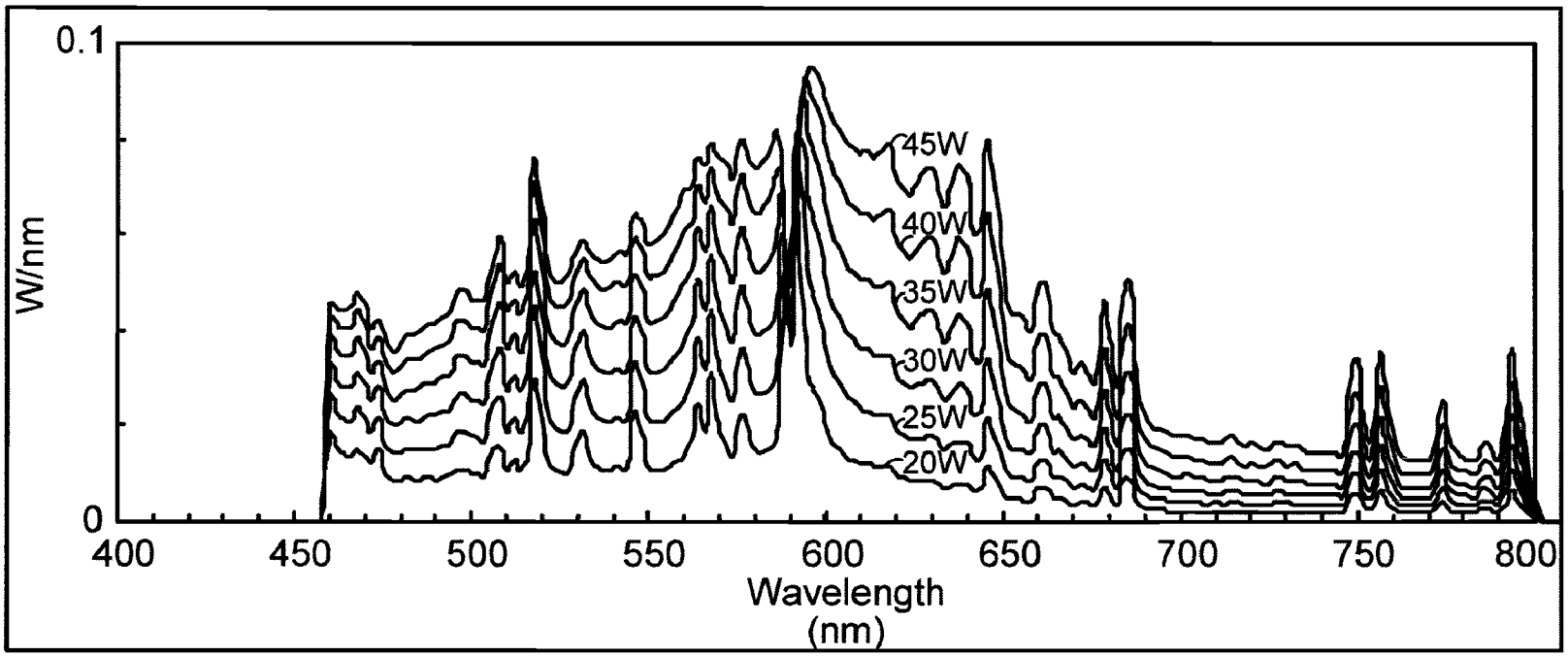
FIG. 4*a* illustrates the spectral output of the metal halide lamp shown in FIG. 3, but with the spectrum containing enhanced emission due to dimming filtered by a long-pass filter, in accordance with an embodiment of the present invention.
Figure 4B:
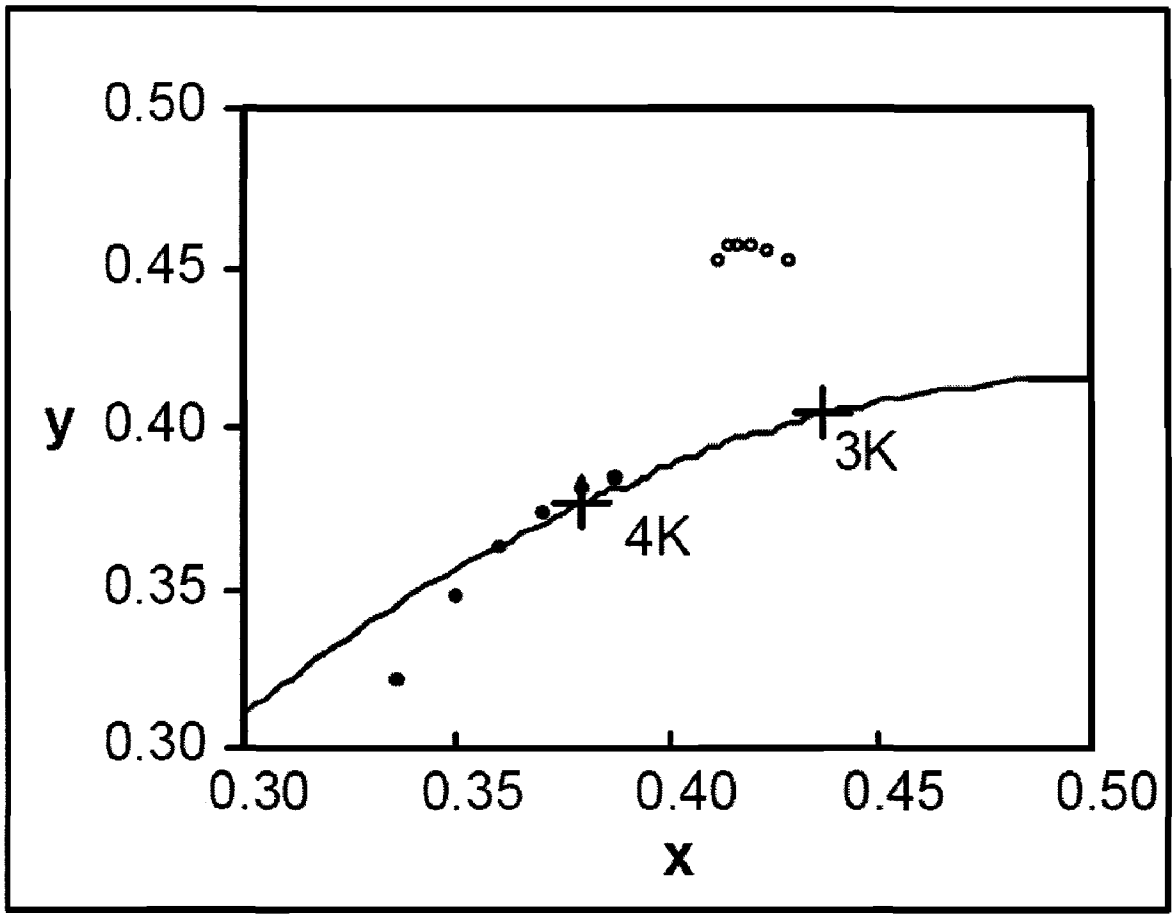
FIGS. 4*b*, 4*c* and 4*d* show the chromaticity drift, efficacy (LPW), and CRI, respectively, of the unfiltered spectra (designated with solid circles) compared to the filtered spectra (designated with open circles)
Figure 4C:
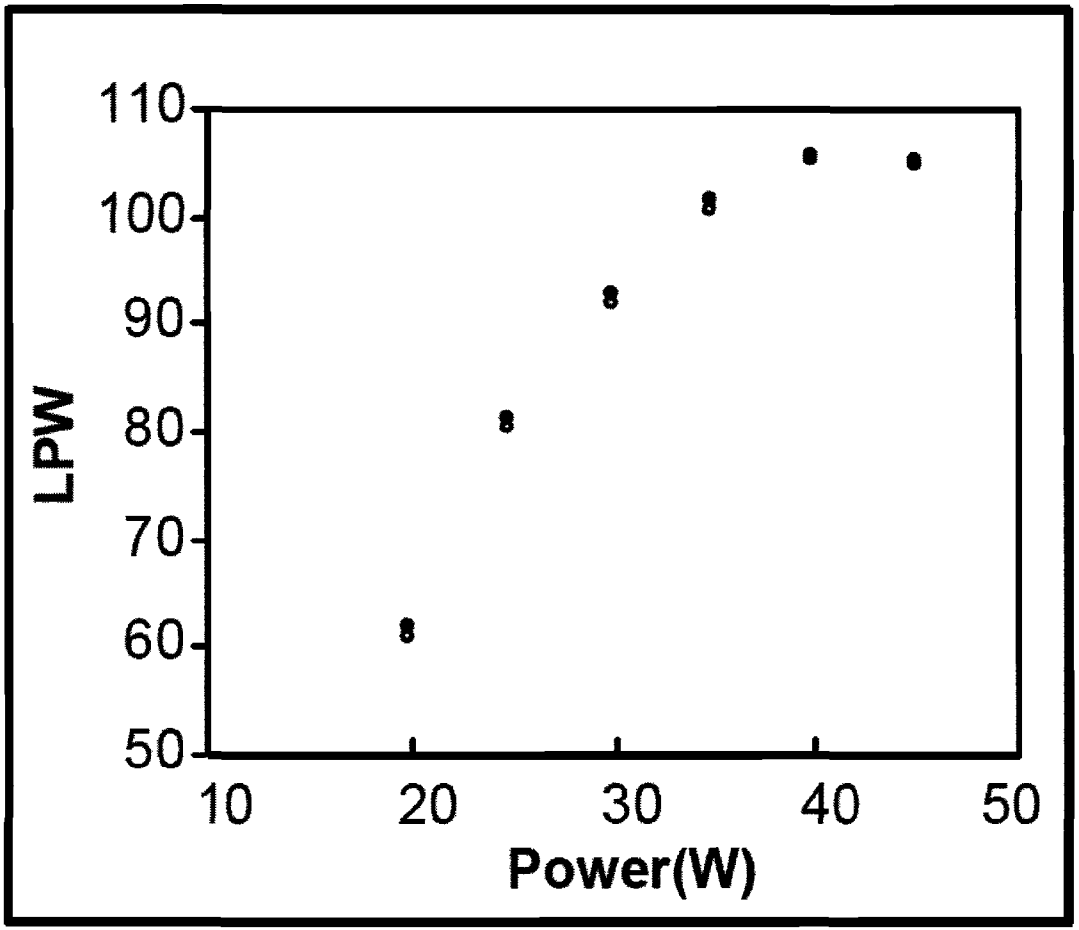
Figure 4D:
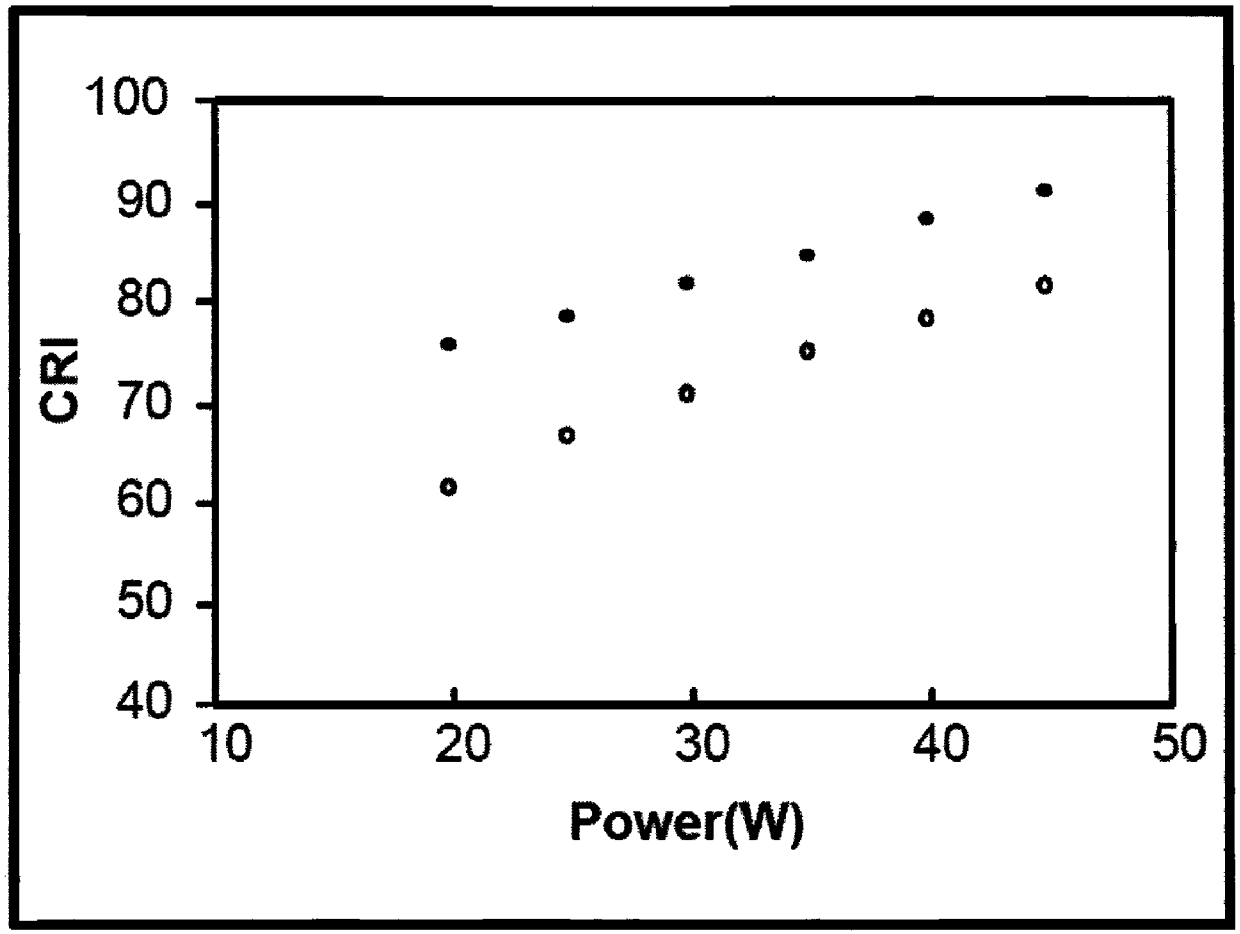

For instance, a long-pass filter can be used to remove the short wavelength part of the spectrum. The spectra at dimmed powers, as modified by such a long-pass filter, is shown in FIG. 4*a*. The plots shown in FIGS. 4*b*, 4*c* and 4*d* show the chromaticity drift, efficacy (LPW), and CRI, respectively, of the filtered spectra (designated with open circles) compared to the unfiltered spectra (designated with solid circles). As can be seen in FIG. 4*b*, the corresponding chromaticity shift during dimming is less when filtering is applied. Note that the filtering in this example affects a part of the spectrum where the relative sensitivity of the human eye is low, so the efficacy (LPW) is negligibly affected, as shown in FIG. 4*c*. There is however, some decrease in the CRI as shown in FIG. 4*d*, which may or may not be acceptable, depending on the given application.

Figure 5A:
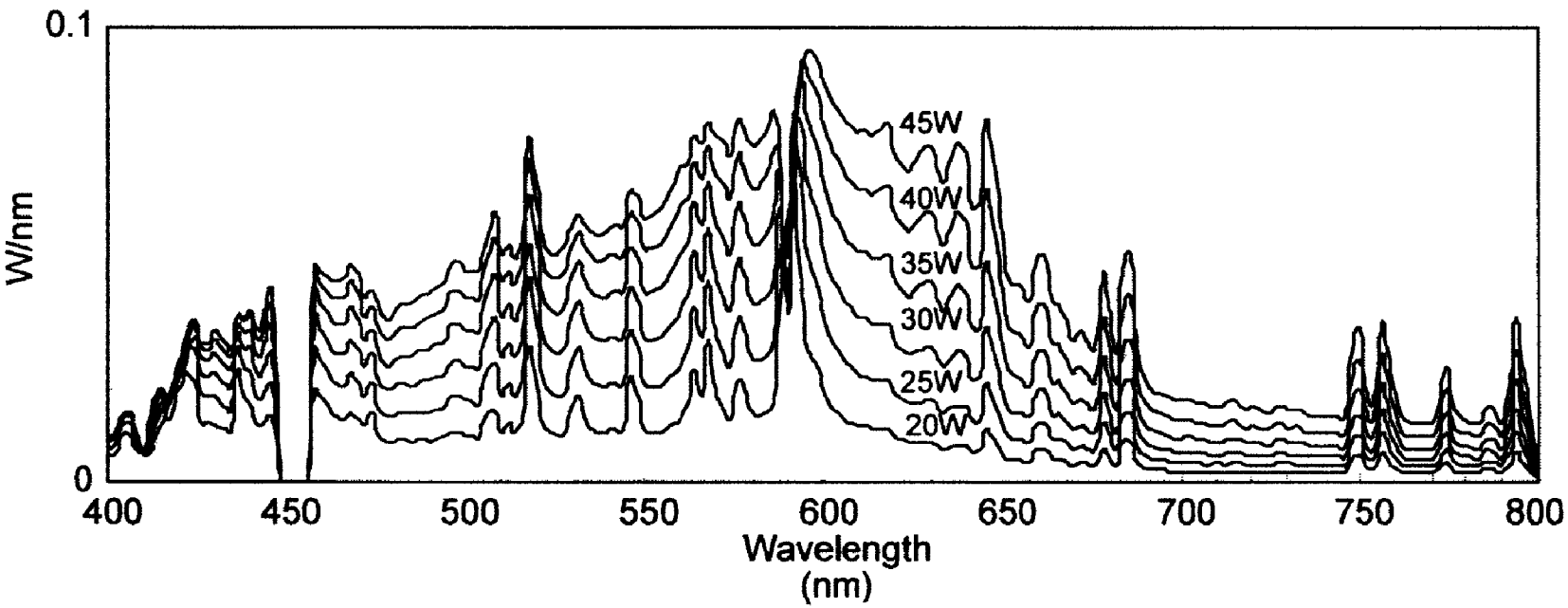
FIG. 5*a* illustrates the spectral output of the metal halide lamp shown in FIG. 3, but with the spectrum containing enhanced emission due to dimming filtered by a notch filter, in accordance with another embodiment of the present invention.
Figure 5B:
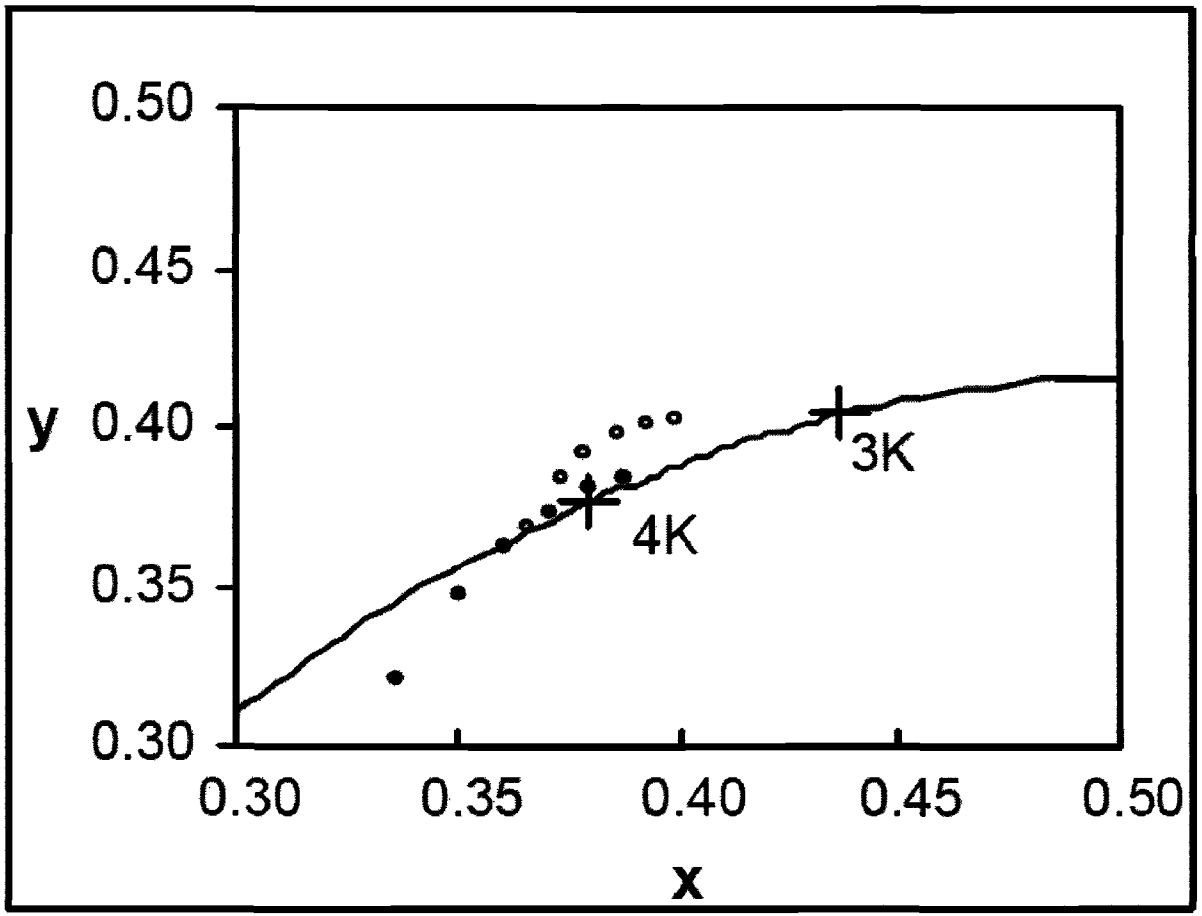
FIGS. 5*b*, 5*c* and 5*d* show the chromaticity drift, efficacy (LPW), and CRI, respectively, of the unfiltered spectra (designated with solid circles) compared to the filtered spectra (designated with open circles)
Figure 5C:
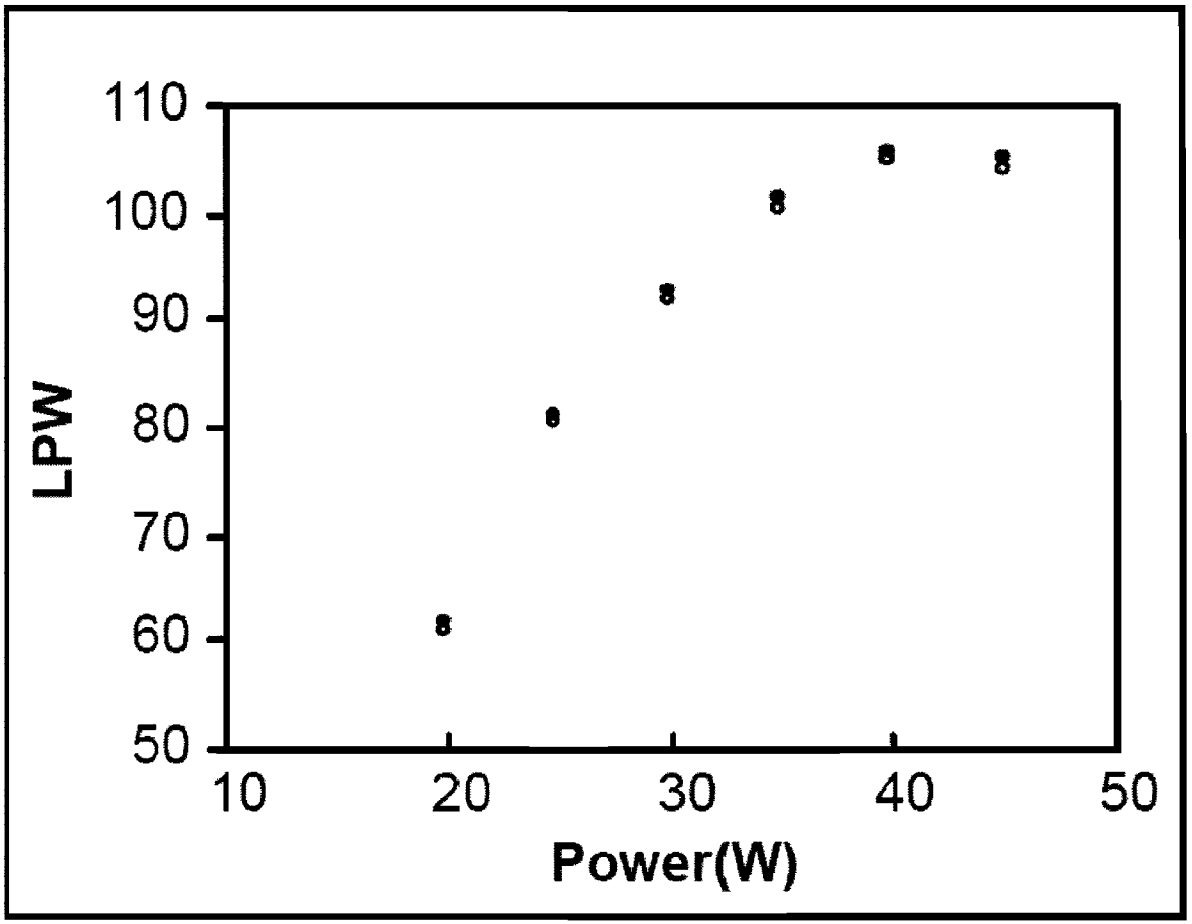
Figure 5D:
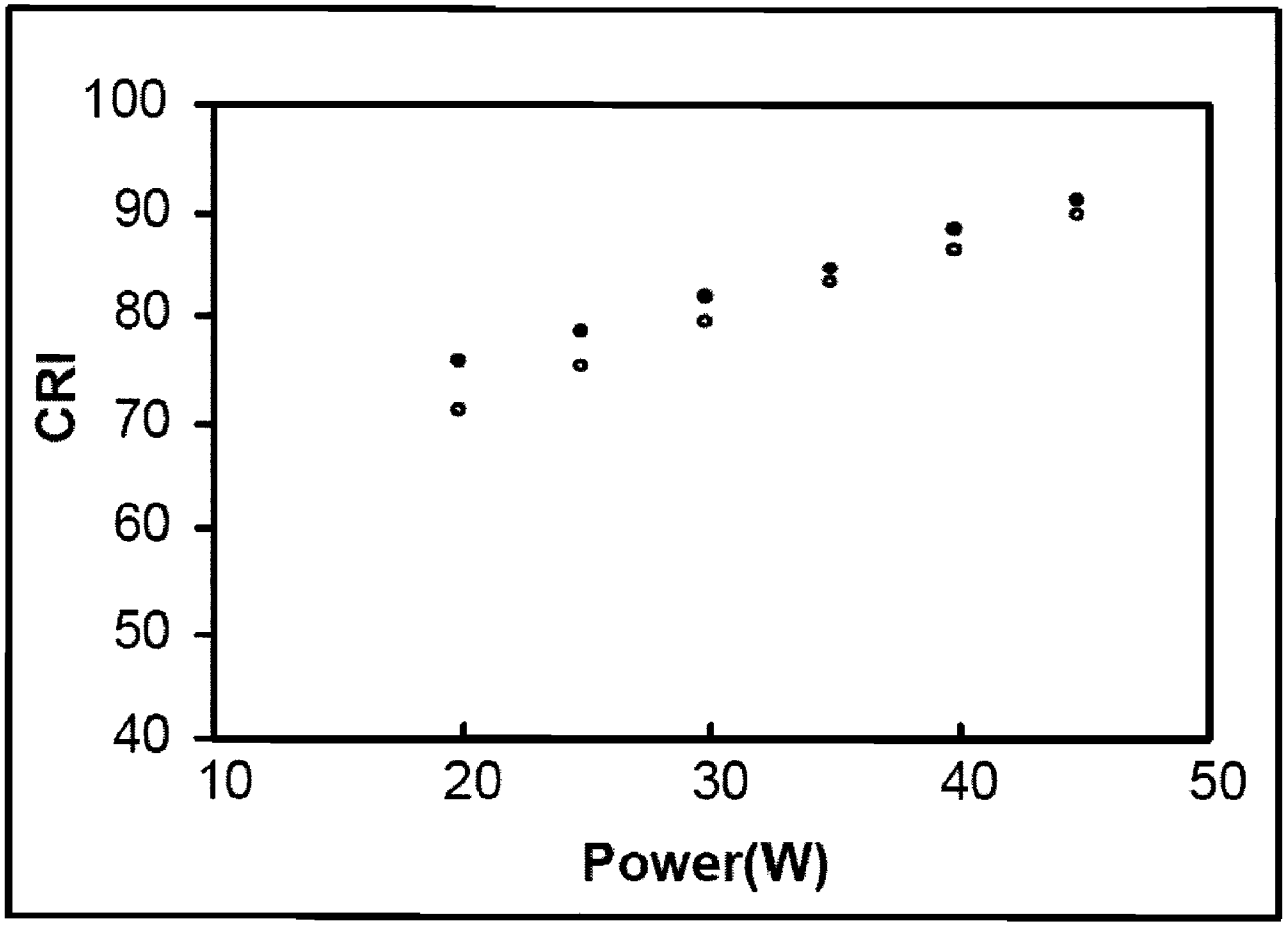

In an alternative embodiment, a notch filter that blocks radiation in a narrower band at around 452 nm can be used to also reduce the decrease in CRI (for applications where such CRI decrease in not acceptable). The spectra at dimmed powers, as modified by such a notch filter, is shown in FIG. 5*a*. The plots shown in FIGS. 5*b*, 5*c* and 5*d* show the chromaticity drift, efficacy (LPW), and CRI, respectively, of the filtered spectra (designated with open circles) compared to the unfiltered spectra (designated with solid circles). As can be seen, the chromaticity shift is reduced (FIG. 5*b*) and the efficacy (LPW) is negligibly affected (FIG. 5*c*), but the CRI is less affected (FIG. 5*d*) relative to the impact on CRI by the long-pass filter (FIG. 4*d*).

Note that the filtered spectra shown in FIGS. 4*a* and 5*a* reflect ideal filtering by a perfect filter with sharp cut-offs, 100% transmission at some wavelengths, and 0% transmission at other wavelengths. As will be appreciated, while actual filters may approach perfection, they generally have a softer cut-off and transition from low to high transmission over a finite range of wavelengths (edge steepness), and their high transmission might be 95% or less, for example. In any case, a filter (even those less than perfect) can be used to reduce chromaticity drift as described herein. Further note, however, that due to an attenuated transmission (e.g., 95% or less), the LPW for a filtered lamp may be somewhat more depressed (e.g., by 5 to 20%), instead of mostly unaffected as illustrated in FIGS. 4*c* and 5*c*.

Methodology

Figure 6:
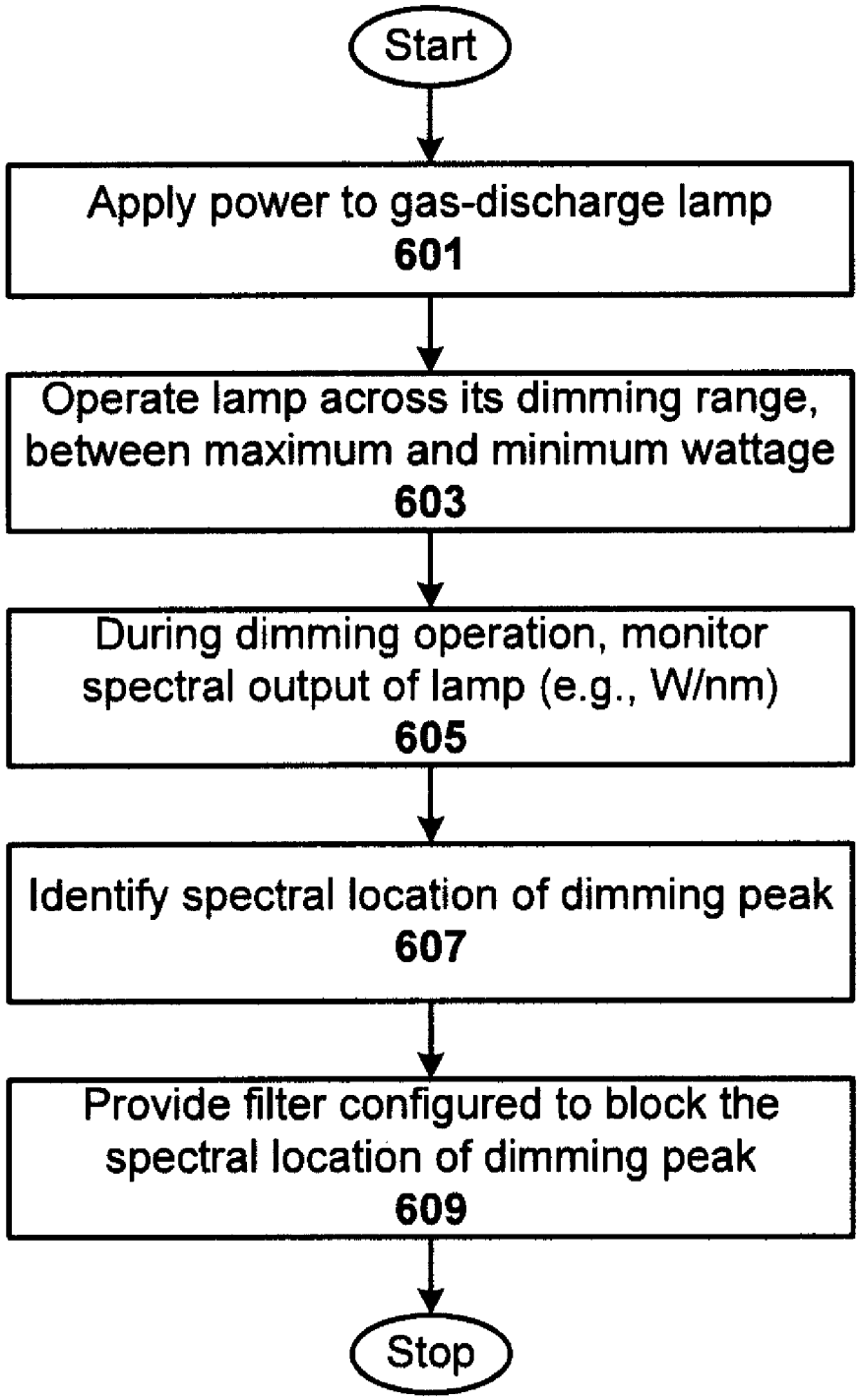
FIG. 6 illustrates a method for filtering discharge lamp emission to control chromaticity drift in dimming applications.

FIG. 6 illustrates a method for filtering discharge lamp emission to control chromaticity drift in dimming applications. The discharge lamp can be a metal halide lamp, or any other lamp susceptible to dimming-induced chromaticity drift caused by enhanced spectral output at one or more narrow band locations in the spectrum.

The method begins with applying power 601 to the discharge lamp, and operating 603 the lamp across its dimming range, between a maximum and minimum wattage (or simply between a high and low wattage, within the lamp's overall range). During this dimming operation, the method further includes monitoring 605 the spectral output of lamp (e.g., W/nm). This monitoring can be accomplished, for example, using a conventional spectroscope or other suitable monitoring equipment capable of measuring light output within a spectrum.

The method continues with identifying 607 a spectral location of a dimming peak. Recall that a dimming peak generally corresponds to an emission at a lower wattage that is higher (hence, enhanced) than an emission at that same location at a higher wattage. In some such cases, for example, the lamp emission in one part of the spectrum is higher at the lowest lamp wattage relative to the highest lamp wattage. However, this relationship is not required for a dimming peak to exist. Other dimming peak scenarios will be apparent in light of this disclosure, particularly where an enhanced emission occurs at least in part due to a dimming operation.

For instance, in some cases, the filtering as described herein can be used to mask increases in line intensity that occur during dimming, in particular due to reduced self-absorption. But there are also other reasons why a particular emission line might increase or even decrease during dimming (e.g., in many cases, lines generally decrease with dimming). In this sense, it is the change in relative intensity between different parts of the spectrum that is relevant, and the dimming peak may be 'enhanced' because it reflects increased intensity or decreased intensity, relative to other spectral locations. Filtering out such enhanced spectral changes as described herein effectively reduces the observed chromaticity drift, regardless of whether the enhanced emission results from peaks that are increasing or decreasing in intensity. Thus, identifying a spectral location of a dimming peak may include identifying an enhanced emission that is either decreased or increased relative to other parts of the spectrum, particularly when that enhanced emission occurs at least in part due to a dimming operation.

The method continues with providing 609 a filter configured to block the spectral location of the dimming peak. As previously explained, this filtering of lamp emission can be accomplished, for example, by special coatings and/or materials used to make the arc tube, shroud, outer jacket, and/or other suitable feature of the lamp construction. Alternatively, the lamp can be filtered by a filter construction that is external to or otherwise discrete from the lamp, such as an enclosure in which the lamp resides, where a transparent surface of the enclosure is coated or otherwise configured with the appropriate filter. A combination of short-pass, long-pass, band-pass, and/or notch filters can be employed to filter discrete parts of the spectrum, as needed to suppress dimming-induced chromaticity shift. Likewise, some spectral locations can be multi-filtered, by two or more filters that may or may not be the same filter type (e.g., double long-pass filter where each long-pass filter edge is in the same location or within 20% of the other, or a long-pass filter combined with the notch filter where the notch filter is used to improve the steepness of the long-pass filter edge).

Note that once this method is performed for a given lamp configuration, other similarly configured lamps can have a similar filter applied or otherwise integrated therein, without repeating steps 601 through 607. Thus, for instance, the method can be run once or an otherwise minimal number of times to verify a process for manufacturing a gas-discharge lamp for a given application (or set of applications). Once the manufacturing process is verified, other similarly configured lamps destined for that application can have the filter installed (without verification), and it can be assumed those lamps will also be capable of reducing dimming-induced chromaticity drift.

Thus, according to one embodiment of the present invention there is provided a gas-discharge lamp. The lamp generally includes an arc tube, and a filter specifically configured to block a spectral location of a dimming peak where an enhanced emission occurs at least in part due to the dimming operation, thereby reducing dimming-induced chromaticity drift of the lamp. In one particular case, the lamp operates between low and high wattages of the lamp, and the spectral location of the dimming peak includes a location where lamp emission at the low wattage is higher than lamp emission at the high wattage. In another particular case, the lamp further includes at least one of an evacuated outer jacket and a shroud within the outer jacket, wherein the filter is deposited on and/or integrated into at least one of the arc tube, the shroud, and/or the outer jacket. In one specific such case, the filter is deposited on and/or integrated into the outer jacket. In another particular case, the lamp further includes a lens, and the filter is deposited on and/or integrated into the lens. In another particular case, the filter includes at least one of a short-pass filter, long-pass filter, bandpass filter, and/or notch filter. In another particular case, the lamp includes a second filter specifically configured to block a spectral location of a second dimming peak where an enhanced emission occurs at least in part due to the dimming operation. Recall that the enhanced emission may represent an increase or decrease in the dimming peak intensity, relative to other spectral locations.

According to another embodiment of the present invention, a gas-discharge lamp is provided that generally includes an evacuated outer jacket, a shroud within the outer jacket, and an arc tube within the shroud. The lamp further includes a first filter specifically configured to block a spectral location of a first dimming peak where an enhanced emission occurs at least in part due to the dimming operation, thereby reducing dimming-induced chromaticity drift of the lamp, wherein the lamp operates between low and high wattages of the lamp, and the spectral location of the first dimming peak includes a location where lamp emission at the low wattage is higher than lamp emission at the high wattage. The lamp further includes a second filter specifically configured to block a spectral location of a second dimming peak where an enhanced emission occurs at least in part due to the dimming operation. In one particular case, the filter is deposited on and/or integrated into at least one of the arc tube, the shroud, and/or the outer jacket. In another particular case, the filter is deposited on and/or integrated into the outer jacket. In another particular case, the lamp further includes a lens, and the filter is deposited on and/or integrated into the lens. In another particular case, the filter includes at least one of a short-pass filter, long-pass filter, bandpass filter, and/or notch filter. In another particular case, the filter includes multiple filters (with or without overlapping rejection bands). Again, recall that the enhanced emission may represent an increase or decrease in the dimming peak intensity, relative to other spectral locations.

According to another embodiment of the present invention, a method is provided for filtering gas-discharge lamp emission to control chromaticity drift in dimming applications. The method includes operating a gas-discharge lamp across its dimming range, and monitoring spectral output of the lamp during dimming operation. The method continues with identifying a spectral location of a dimming peak, where an enhanced emission occurs at least in part due to the dimming operation. The method further includes providing a filter specifically configured to block the spectral location of the dimming peak, thereby reducing dimming-induced chromaticity drift of the lamp. In one such case, operating the lamp across its dimming range includes operating the lamp between maximum and minimum wattages of the lamp. In another such case, operating the lamp across its dimming range includes operating the lamp between low and high wattages of the lamp, and identifying a spectral location of the dimming peak includes identifying a location where lamp emission at the low wattage is higher than lamp emission at the high wattage. In another such case, the filter is associated with at least one of an arc tube, shroud, outer jacket, and/or lens of the lamp. In another such case, the filter includes at least one of a short-pass filter, long-pass filter, bandpass filter, and/or notch filter. In another such case, the method further includes providing the filter to other gas-discharge lamps similarly configured, without having to perform the operating, monitoring, identifying, and providing steps. In another such case, the method further includes identifying a spectral location of a second dimming peak, where an enhanced emission occurs at least in part due to the dimming operation, and providing a second filter specifically configured to block the spectral location of the second dimming peak. Again, recall that the enhanced emission may represent an increase or decrease in the dimming peak intensity, relative to other spectral locations.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A method for filtering gas-discharge lamp emission to control chromaticity drift in dimming applications, comprising:

operating a gas-discharge lamp across its dimming range;

monitoring spectral output of the lamp during dimming operation;

identifying a spectral location of a dimming peak, where an enhanced emission occurs at least in part due to the dimming operation; and providing a filter specifically configured to block the spectral location of the dimming peak, thereby reducing dimming-induced chromaticity drift of the lamp.

2. The method of claim 1 wherein operating the lamp across its dimming range includes operating the lamp between maximum and minimum wattages of the lamp.

3. The method of claim 1 wherein operating the lamp across its dimming range includes operating the lamp between low and high wattages of the lamp, and identifying a spectral location of the dimming peak includes identifying a location where lamp emission at the low wattage is higher than lamp emission at the high wattage.

4. The method of claim 1 wherein the filter is associated with at least one of an arc tube, shroud, outer jacket, and lens of the lamp.

5. The method of claim 1 wherein the filter includes at least one of a short-pass filter, long-pass filter, bandpass filter, and notch filter.

6. The method of claim 1 further comprising:

providing the filter to other gas-discharge lamps similarly configured, without having to perform the operating, monitoring, identifying, and providing steps.

7. The method of claim 1 further comprising:

identifying a spectral location of a second dimming peak, where an enhanced emission occurs at least in part due to the dimming operation; and providing a second filter specifically configured to block the spectral location of the second dimming peak.

8. A gas-discharge lamp, comprising:

an arc tube;

a filter specifically configured to block a spectral location of a dimming peak where an enhanced emission occurs at least in part due to a dimming operation, thereby reducing dimming-induced chromaticity drift of the lamp; and a second filter specifically configured to block a spectral location of a second dimming peak where an enhanced emission occurs at least in part due to the dimming operation.

9. The lamp of claim 8 wherein the lamp operates between low and high wattages of the lamp, and the spectral location of the dimming peak includes a location where lamp emission at the low wattage is higher than lamp emission at the high wattage.

10. The lamp of claim 8 further comprising at least one of an outer jacket and a shroud within the outer jacket, wherein the filter is deposited on or integrated into at least one of the arc tube, the shroud, and the outer jacket.

11. The lamp of claim 10 wherein the filter is deposited on or integrated into the outer jacket.

12. The lamp of claim 8 wherein the lamp further includes a housing with a lens, and the filter is deposited on or integrated into the lens.

13. The lamp of claim 8 wherein the filter includes at least one of a short-pass filter, long-pass filter, bandpass filter, and notch filter.

14. A gas-discharge lamp, comprising:

an outer jacket, a shroud within the outer jacket;

an arc tube within the shroud, the arc tube containing a metal halide salt mixture; and a filter specifically configured to block a spectral location of a dimming peak where an enhanced emission occurs at least in part due to a dimming operation, thereby reducing dimming-induced chromaticity drift of the lamp, wherein the lamp operates between low and high wattages of the lamp, and the spectral location of the dimming peak includes a location where lamp emission at the low wattage is higher than lamp emission at the high wattage.

15. The lamp of claim 14 wherein the filter is deposited on or integrated into at least one of the arc tube, the shroud, and the outer jacket.

16. The lamp of claim 14 wherein the filter is deposited on or integrated into the outer jacket.

17. The lamp of claim 14 wherein the lamp further includes a housing with a lens, and the filter is deposited on or integrated into the lens.

18. The lamp of claim 14 wherein the filter includes at least one of a short-pass filter, long-pass filter, bandpass filter, and notch filter.

19. The lamp of claim 14 wherein the metal halide salt mixture includes at least one of Na, Tl, Dy, Ho, and Tm.

* * * * *